United States Patent [19]

Erickson

[11] 4,252,499

[45] Feb. 24, 1981

[54] CENTRIFUGAL PUMP

[75] Inventor: John W. Erickson, Huntington Beach, Calif.

[73] Assignee: Kobe, Inc., Commerce, Calif.

[21] Appl. No.: 80,617

[22] Filed: Oct. 1, 1979

[51] Int. Cl.[3] ..... F04D 1/14

[52] U.S. Cl. ..... 415/52; 415/89

[58] Field of Search ..... 415/52, 53 R, 88, 89

[56] References Cited

U.S. PATENT DOCUMENTS 3,795,459 3/1974 Erickson et al. ..... 415/89

3,926,534 12/1975 Erickson ..... 415/89

FOREIGN PATENT DOCUMENTS 732770 3/1943 Fed. Rep. of Germany ..... 415/89

*Primary Examiner*—Louis J. Casaregola

*Attorney, Agent, or Firm*—William C. Norvell, Jr.

[57] ABSTRACT

A centrifugal pump of the pitot pump type is provided a stationary vane structure containing a pitot tube mounted inside a rotating casing. Fluid is delivered to a pumping chamber within the casing through a plurality of radially extending ducts of at least two disparate radii in the wall of the casing which discharge fluid by centrifugal force into the casing. The disparate radii of the ducts induce inward fluid circulation in the shorter ducts and outward circulation in the longer ducts which improves the low flow-pressure characteristic of the pump. An air extraction tube provides communication between the central portion of the pumping chamber and the inlet of the radially extending ducts to provide for the extraction of air from the interior of the pumping chamber to further improve the pumping efficiency.

6 Claims, 5 Drawing Figures

CENTRIFUGAL PUMP

BACKGROUND OF THE INVENTION

1. Field of the Invention

This invention relates to centrifugal pumps, and more particularly is concerned with pitot pumps.

2. Brief Description of the Prior Art

Pitot pumps are a form of centrifugal pumps. Typically, a pitot pump is constructed by providing a hollow rotatable casing disposed within a suitable surrounding stationary housing. A plurality of radial ducts in the walls of the casing directs the fluid to be pumped outwardly by centrifugal force as the casing is rotated, the fluid being discharged into the interior of the rotating casing. Stationary pitot tube means in the interior of the casing intercept the rotating fluid in the casing, the ram effect forcing fluid out through the pitot tubes. Pitot pumps of this type are well known and typically are illustrated and described in U.S. Pat. No. 3,384,024 entitled "Centrifugal Pump", William L. Kind, owned by the assignee of the present invention.

The prior art apparatus includes a rotating housing and a stationary pickup tube collector arm within the rotating housing. The fluid to be pumped enters an intake manifold and passes into the rotating housing wherein the velocity of the fluid is increased. Centrifugal force induced by the rotating housing forces the fluid introduced therein to the peripheral outer extremities of the rotating housing through a plurality of discrete radial passages which are typically formed in an end wall of the rotating housing. The fluid is forced to the outlets of the radial passages from which the fluid is injected at high velocity or high pressure, if the pumping chamber is already filled with fluid, into the main pumping chamber. The velocity energy of the fluid within the pumping chamber is converted into additional energy as it jets into the pickup tube and thence to a discharge conduit. During certain portions of the pumping cycle it is desirous to permit a recirculation of the fluid being pumped. Typically, the desired recirculation of the fluid in the prior art structures has been accomplished from the pumping chamber of the rotating casing to the radial passages through a labyrinth type rotating seal means. In the event the labyrinth leakage is prevented, unacceptable pumping characteristics manifest themselves.

Also, it has been found that undesirable pumping characteristics have become apparent due to the presence of air in the pumping chamber of the rotating casing.

SUMMARY OF THE INVENTION

It is an object of the invention to produce a centrifugal pump apparatus having acceptable pumping characteristics by utilizing inlet ducts in the rotating housing of alternating radii to permit the fluid being pumped to be circulated inwardly through the shorter radii inlet ducts and thence outwardly through the longer radii inlet ducts during certain portions of the pumping cycle.

Another object of the invention is to produce a centrifugal pump having a single stage capable of pumping fluids at high pressures.

Another object of the invention is to produce a centrifugal pump capable of removing gas accumulated within the central zone of the pumping chamber and causing the same to be removed along with the fluid being pumped.

Another object of the invention is to produce a centrifugal pump apparatus capable of removing accumulated gas from the pumping chamber employing a minimal number of moving parts.

Still another object of the invention is to produce a centrifugal pump apparatus of simplified construction at low cost and requiring a minimum of maintenance.

The above objects, as well as other objects of the invention, can be achieved by a centrifugal pump apparatus comprising: a rotary casing mounted for rotation about an axis and having a pumping chamber; a pumped fluid discharge duct coaxial with the casing; stationary fluid intake passage means extending radially outwardly of the axis of the casing into the pumping chamber thereof; pitot tube means having an inlet facing in a direction opposite to the direction of rotation of the casing for gathering from the pumping chamber fluid to be pumped, the pitot tube means having a passage connected to the inlet and extending generally in the direction of the rotation of the casing and toward the axis to an outlet connected to the discharge duct for discharging to an outlet port fluid gathered from the chamber by the pitot tube means; delivery means for delivering fluid to be pumped to the pumping chamber proximately of the outer periphery thereof, the delivery means including an inlet supply passage coaxially of the casing, and radially extending supply duct means in an end wall of the casing for delivering fluid from the supply passage to the periphery of the pumping chamber, the duct means including at least two spaced apart ducts opening into the pumping chamber at different radial lengths; and fluid-tight rotary seal means militating against fluid flow between the radially inner portions of the supply duct means of the delivery means and the pumping chamber of the casing.

Other objects and advantages of the invention become readily apparent to one skilled in the art from reading the following detailed description of the preferred embodiment of the invention.

DESCRIPTION OF THE PREFERRED EMBODIMENTS

Figure 1:
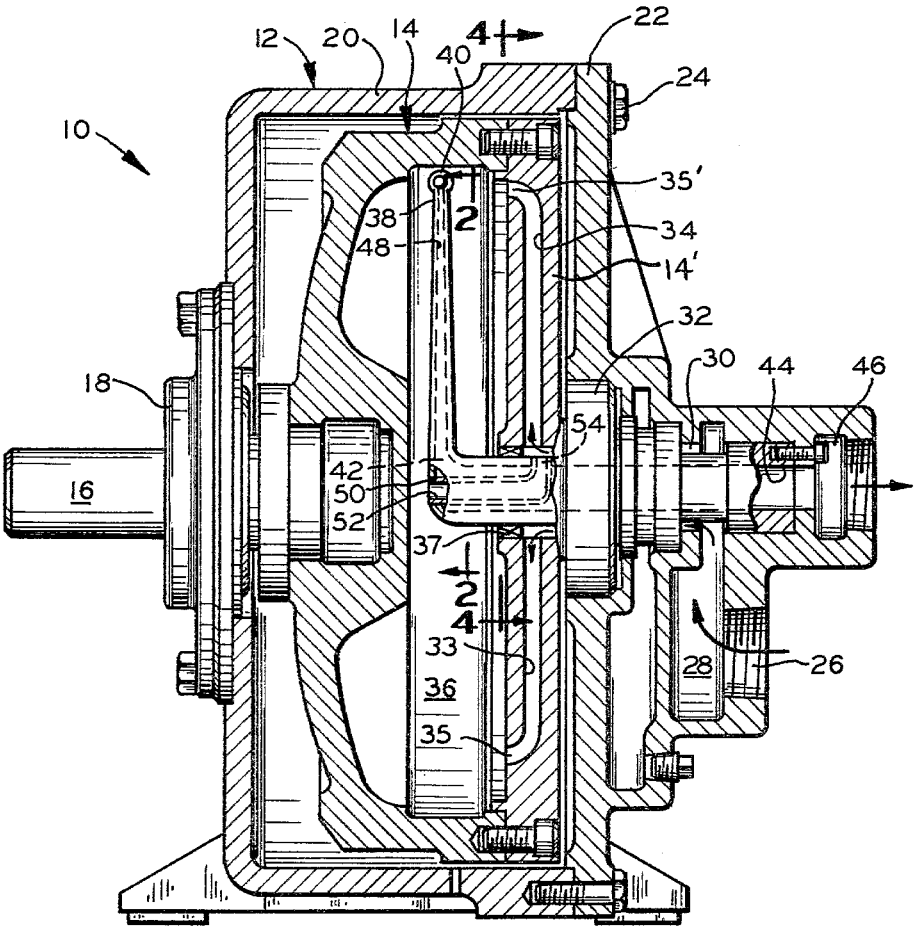
FIG. 1 is a sectional view of a centrifugal pump apparatus incorporating the features of the invention.
Figure 2:
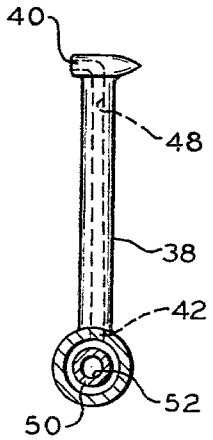
FIG. 2 is a fragmentary sectional view of the apparatus illustrated in FIG. 1 taken along line 2—2 thereof.

Referring to FIGS. 1 and 2, there is illustrated a centrifugal pump of the pitot type generally indicated by reference numeral 10. The pitot pump 10 includes a stationary outer housing 12 and a hollow rotary casing 14. The outer housing 12 can be suitably supported by a conventional footing structure suitably secured thereto. The casing 14 is typically mounted coaxially to a drive shaft 16 of an electric motor (not shown), for example, which is connected to the stationary housing by means of a motor support and bearing assembly 18, for rotation about a central axis which is also the axis of symmetry of the casing 14. The housing 12 is typically composed of an annular casting 20 open at one end opposite from the driving motor and associated drive shaft 16 where it is closed by a cover 22. The annular casting 20 and the cover 22 are rigidly secured together, as by suitable threaded fasteners 24. The bearing assembly 18 additionally includes seal means which cooperates with the drive shaft 16 to prevent leakage of fluid from the interior of the housing 12. Also, it will be appreciated that the drive shaft 16 is provided with suitable bearing means (not shown) so that it can carry the rotating casing 14 in a cantilevered fashion within the chamber of the stationary outer housing 12.

The housing cover 22 includes a main inlet 26 for fluid to be pumped. The inlet 26 communicates with an internal chamber 28 which in turn leads to an annular inlet passage 30 formed coaxially through an axial inlet hub bearing 32 of the rotating casing 14.

Figure 4:
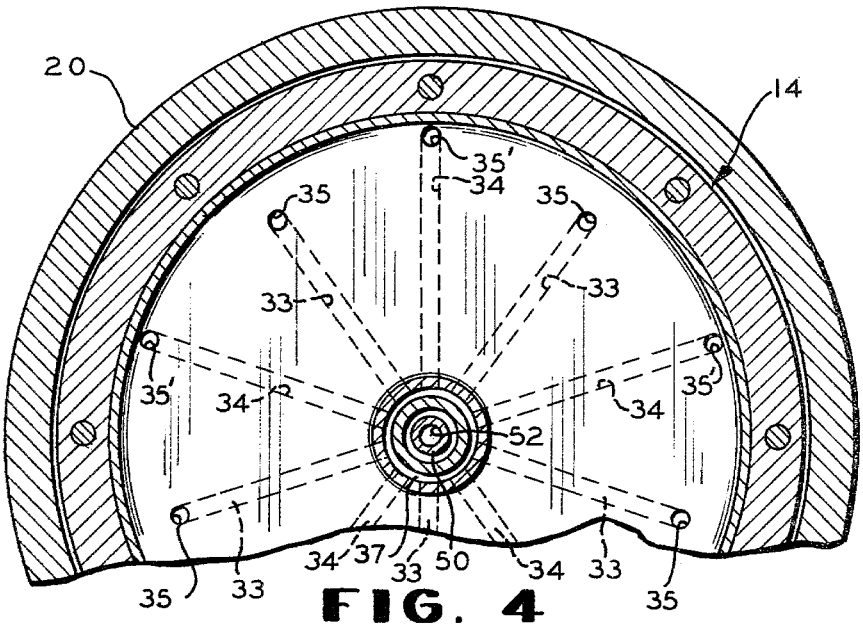
FIG. 4 is a fragmentary sectional view of the apparatus taken along line 4—4 of FIG. 1.

The end wall 14' of the rotating casing 14 defines first and second pluralities of radially extending ducts 33 and 34, respectively. The ducts 33 and 34 extend from inlet passage 30 outwardly to the peripheral region of a generally circular pumping chamber 36 defined by the rotating casing 14. As illustrated in FIG. 4, the first plurality of ducts 33 includes those ducts having a shorter radial length which terminate in plural outlets 35. The second plurality of ducts 34 includes those ducts having a longer radial length which terminate in plural outlets 35'. The radial ducts 33 and 34 provide fluid flow communication between the annular inlet passage 30 and the interior of the pumping chamber 36. Centrifugal force resulting from rotation of the casing 14 pumps fluid outwardly through the ducts 33 and 34 and into the interior of the pumping chamber at higher rotational speeds whereas the differential in centrifugal pumping force associated with the disparate radial lengths of the ducts 33 and 34 causes recirculation therewithin and improves the pressure characteristic of the pump at low flow rates in a manner to be more fully described subsequently.

It will be noted that a rotary seal member 37 is disposed at the radially inner terminus of the inwardly facing wall of the rotary casing 14 and provides a fluid-tight sealing relation between the relatively rotating inner wall of the rotating casing 14 which defines one wall of the radially outwardly extending ducts 34 and the interior of the pumping chamber 36.

Disposed within the pumping chamber 36 is a stationary pitot or pickup tube 38 which extends radially from the rotational axis of the rotating casing 14. The pitot tube 38 defines an inlet 40 adjacent its outer end which faces in a direction opposite to the direction of rotation of the rotating casing 14. The pitot tube 38 has an outlet 42 coaxial with the rotational axis of the rotating casing 14 and in communication with an axial discharge duct 44 which, in turn, is in communication with an outlet 46 of the stationary housing 12.

It will be noted that the annular inlet passage 30 surrounds the axial discharge duct 44 throughout a portion of the length thereof which is defined by a bore through the outlet portion of the stationary housing 12. Positioned within the pitot or pickup tube 38 is an internal passage 48 which is connected to the inlet 40 facing in the direction opposite to the direction of the rotation of the casing 14. The passage 48 extends toward the axis of the pump where it communicates with the outlet 42. It will be appreciated that the pitot or pickup tube structure is supported in a stationary manner within the cover 22 of the stationary housing 12 such that the casing 14 can rotate relative thereto. Thus, the fluid to be pumped and the pump fluid enter and leave the pump assembly in a counterflow manner coaxially of the rotating casing 14 through the inlet 26 and the outlet 46 which are disposed at the end of the pump opposite that of the drive shaft 16.

The general mode of operation of this apparatus as a pitot pump is achieved by rotating the casing 14 at a high speed in a predetermined direction about its rotational axis, causing the radially extending ducts 33 and 34 collectively to function as a centrifugal pump to draw fluid to be pumped into the inlet 26, to discharge such fluid through the outlets 35 and 35' and into the pumping chamber 36 adjacent the outer periphery of the casing 14. The fluid in the pumping chamber 36 rotates with the casing 14 and enters the inlet 40 of the pitot tube 38, the pressure of the fluid entering the pitot inlets being increased by a ram effect which converts the velocity head of such fluid into pressure due to the configuration of the pitot passage 48. The pumped fluid entering the pitot tube flows through the internal pitot passage 48, into the discharge duct 44, and thence to the main outlet port 46 from the housing 12.

Figure 3:
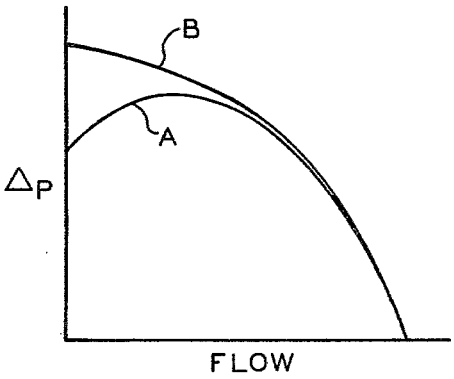
FIG. 3 illustrates typical curves to pump characteristics with and without the structure of the invention.

In previous pumps of this character, a labyrinth seal means is typically disposed between the radially inner ends of the ducts 33 and 34 and the axially inner portion of the pumping chamber 36. The labyrinth seal controls the amount of recirculating fluid within the interior of the rotating casing 14 particularly at the commencement of a pumping cycle. It has been found that to completely seal off the passage provided by the labyrinth, the pumping characteristics of the resultant pumps are exemplified by curve A in FIG. 3. From a practical standpoint, such a curve is unacceptable and a curve such as shown in curve B of FIG. 3 is required. Curve B shows a continuous curve exhibiting the desired pressure rise in the pump output as flow through the pump decreases. Maintaining the initial recirculation rate between the radially extending ducts 33 and 34 and the interior of the pump chamber 36 at all flow rates, however, causes an appreciable decrease in the overall efficiency of the pump due to the pumping energy involved and the turbulence created in the inlet portion of the inlet passage against the inlet flow.

Figure 5:
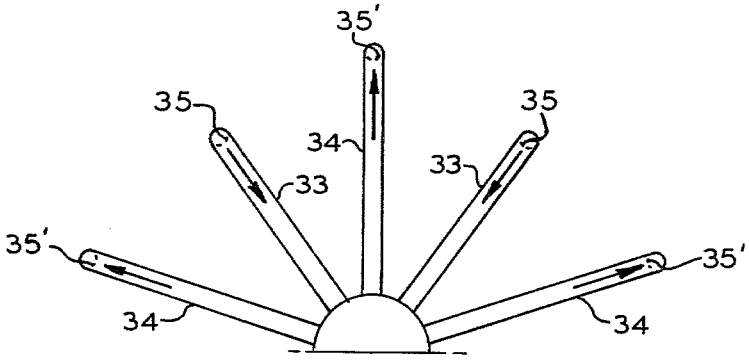
FIG. 5 is a diagrammatic view of the supply ducts which illustrates the circulation therewithin.

It has been found that this problem is alleviated by creating a recirculating path, other than through the labyrinth zone, which is accomplished in the present apparatus. With the present apparatus, the method of obtaining the desired recirculation is by employing at least two pluralities of ducts 33 and 34 of disparate lengths, wherein the ducts 33 are radially shorter than the ducts 34. Such a configuration functions to initially cause a fluid flow radially inwardly in the ducts 33, and a recirculation of such fluid radially outwardly through the inlet of the ducts 34, as illustrated in FIG. 5. As the pump is operating at a low flow, there is a pressure drop between the ducts 33 and the ducts 34 effecting the desired recirculation of the fluid therein. It will be appreciated that as the fluid is caused to recirculate from one duct to another the kinetic energy level of the fluid is increased and the desired characteristics of curve B of FIG. 3 is achieved. Near full flow, at the time the pressure difference between the two pluralities of ducts 33 and 34 equals the frictional losses therein, the flow in the ducts 33 will be zero. At full pump flow, the flow of fluid to be pumped is axially outwardly in both of the pluralities of ducts 33 and 34. During this flow condition, the flow of fluid in the ducts 34 is slightly more than the flow in the ducts 33.

In order to achieve still more efficient operation of the pumping apparatus, an air extraction tube 50 is disposed within the apparatus having its inlet 52 in communication with the interior of the pumping chamber 36, and its outlet 54 in communication with the annular inlet passage 30. The air extraction tube 50 is effective to remove the air collected at the center of the pumping chamber 36 of the pump and causes the same to travel through the tube 50 and into the inlet fluid in the annular inlet passage 30. This is accomplished because there is typically a greater pressure at the inlet 52 of the air extraction tube 50 than at the outlet 54 thereof, causing the air to flow out of the pumping apparatus into the inlet fluid to be picked up by the pitot tube 38 and thereafter be discharged from the apparatus. Manifestly, there will be no degredation of the net positive suction head and will aid in the overall efficiency of the pumping apparatus.

It will be appreciated that the structure incorporating the aforementioned invention results in producing a pump apparatus wherein an increase is achieved in the effective net suction head characteristic over similar centrifugal pumping apparatus.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A centrifugal pump comprising: a rotary casing mounted for rotation about its axis and having a pumping chamber; a pumped fluid discharge duct coaxial with said casing; stationary fluid intake passage means extending radially outwardly of the axis of said casing into said pumping chamber thereof, said means defining a pitot tube having its outer end inlet facing in a direction opposite to the direction of rotation of said casing for gathering from said pumping chamber fluid to be pumped, said pitot tube having a passage connected to said inlet and extending generally in the direction of the rotation of said casing and toward the axis of rotation of said rotary casing to an outlet connected to said discharge duct for discharging fluid gathered from said pumping chamber by said pitot tubes; delivery means for delivering fluid to be pumped to said pumping chamber proximately of the outer periphery thereof, said delivery means including an inlet supply passage coaxially of said casing, and radially extending supply duct means in an end wall of said casing for delivering fluid from said supply passage to the periphery of said pumping chamber, said supply duct means including at least two pluralities of ducts having discharge openings, one of said pluralities of ducts having discharge openings disposed at a greater radial distance from said axis than the other of said pluralities of ducts; and fluid-tight rotary seal means militating against fluid flow between the radially inner portion of said supply duct means of said delivery means and said pumping chamber of said casing.

2. The invention defined in claim 1 wherein said radially extending supply duct means of said delivery means includes at least one radially extending duct having a discrete discharge opening near the periphery of said pumping chamber of said casing.

3. The invention defined in claim 1 wherein said radially extending supply duct means of said delivery means includes a plurality of radially extending ducts having discrete discharge openings spaced circumferentially around said end wall of said pumping chamber of said casing near the periphery thereof.

4. The invention defined in claim 1 including an air extraction means providing fluid communication between a central zone of said pumping chamber of said casing and said stationary fluid intake passage means to effect removal of air to said fluid discharge duct along with the fluid being pumped.

5. The invention defined in claim 4 wherein said air extraction means includes a tube providing communication between the central zone of said pumping chamber of said casing and said delivery means.

6. The invention defined in claim 4 wherein said air extraction means includes a conduit providing communication between the central zone of said pumping chamber of said casing and said radially extending supply duct means of said delivery means.

* * * * *